US009506379B2

(12) United States Patent
Dupuis

(10) Patent No.: US 9,506,379 B2
(45) **Date of Patent: *Nov. 29, 2016**

(54) CONCENTRIC CAMSHAFT PHASER

(71) Applicant: Schaeffler Technologies AG & Co. KG, Herzogenaurach (DE)

(72) Inventor: Craig Dupuis, Windsor (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/201,214

(22) Filed: Mar. 7, 2014

(65) Prior Publication Data

US 2014/0251249 A1 Sep. 11, 2014

Related U.S. Application Data

(60) Provisional application No. 61/775,904, filed on Mar. 11, 2013.

(51) Int. Cl.
*F01L 1/34* (2006.01)
*F01L 1/344* (2006.01)
*F01L 1/047* (2006.01)

(52) U.S. Cl.
CPC ..... *F01L 1/344* (2013.01); *F01L 1/047* (2013.01); *F01L 1/3442* (2013.01); *F01L 2001/0473* (2013.01); *F01L 2001/34496* (2013.01); *Y10T 29/49293* (2015.01)

(58) Field of Classification Search
CPC ..... F01L 1/047; F01L 1/344; F01L 1/3442; F01L 2001/0473; F01L 2001/34496
USPC ..... 123/90.17, 90.27, 90.31
See application file for complete search history.

(56) References Cited

U.S. PATENT DOCUMENTS

| | | | | |
|---|---|---|---|---|
| 6,763,791 | B2 | 7/2004 | Gardner et al. | |
| 6,932,039 | B2 * | 8/2005 | Takahashi | F01L 1/02 123/90.15 |
| 8,122,863 | B2 | 2/2012 | Myers | |
| 8,146,551 | B2 * | 4/2012 | Pluta | F01L 1/3442 123/90.15 |
| 8,191,521 | B2 * | 6/2012 | Kandolf | F01L 1/3442 123/90.15 |
| 8,627,795 | B2 * | 1/2014 | Kapp | F01L 1/34 123/90.15 |
| 2008/0283010 | A1 | 11/2008 | Bohner et al. | |
| 2010/0089353 | A1 | 4/2010 | Myers et al. | |

OTHER PUBLICATIONS

Kandolf et al., Camshaft Phase Adjuster for Concentric Camshafts, US Patent Application Pub. 2010/0186700 A1, Jul. 29, 2010.*
Christopher J. Pluta, Concentric Cam with Phaser, US Patent Application Pub. 2010/0186698 A1, Jul. 29, 2010.*
Wigsten et al., Concentric Camshaft Phaser Torsional Drive Mechanism, US Patent Application Pub. 2014/0158074 A1, Jun. 12, 2014.*

* cited by examiner

*Primary Examiner* — Ching Chang
(74) *Attorney, Agent, or Firm* — Simpson & Simpson, PLLC

(57) ABSTRACT

A concentric cam shaft phaser, including: a first camshaft; a second camshaft located radially inside of the first camshaft; a control gear in contact with the first camshaft and fixedly connected to the first camshaft by a weld, a press fit, or a shrink fit; a rotor non-rotatably connected to the second camshaft; and a stator non-rotatably connected to the control gear.

19 Claims, 7 Drawing Sheets

CONCENTRIC CAMSHAFT PHASER

CROSS-REFERENCE TO RELATED APPLICATIONS

This application claims the benefit under 35 U.S.C. §119 (e) of U.S. Provisional Patent Application No. 61/775,904 filed Mar. 11, 2013, which application is incorporated herein in its entirety.

TECHNICAL FIELD

The invention relates generally to camshaft phasers, more specifically to concentric camshaft phasers, and even more specifically to camshaft phasers for diesel engine applications.

BACKGROUND

It is known to use a concentric camshaft phaser (two cam shafts, one radially inside the other) to control an intake or exhaust valve train for an internal combustion engine. It also is known to use a control gear on the camshaft phaser to drive a second gear or gear driven phaser for the intake or exhaust valve train. For proper timing and operation of the phasers, the radial runout of the control gear (circumferential position of the control gear with respect to the cam shafts) must be precisely controlled. The prior art teaches the use of intermediate components, such as fasteners, to secure the control gear to the camshafts. However, the use of intermediate components introduces tolerance variations associated with the components that add an additional degree of error to the runout of the control gear. The introduced tolerances can result in a less precise circumferential location of the control gear with respect to the camshaft, adversely impacting gear durability, and timing of a system using the phaser. In addition, during operation of the phaser, gear loads are indirectly transferred to the camshafts via the phaser, resulting in unreliable radial transfer of the gear loads. Thus, it is difficult to maintain the necessary gear radial runout for reliable, durable, and repeatable operation of the phasers.

SUMMARY

According to aspects illustrated herein, there is provided a concentric cam shaft phaser, including: a first camshaft; a second camshaft located radially inside of the first camshaft; a control gear in contact with the first camshaft and fixedly connected to the first camshaft by a weld, a press fit, or a shrink fit; a rotor non-rotatably connected to the second camshaft; and a stator non-rotatably connected to the control gear.

According to aspects illustrated herein, there is provided a concentric camshaft phaser, including: a first camshaft; a second camshaft located radially inward of the first camshaft; a control gear in contact with a radially outwardly facing surface of the first camshaft and fixedly connected to the first camshaft by a weld, a press fit, or a shrink fit; a rotor non-rotatably connected to the second camshaft; a stator non-rotatably connected to the control gear; and a plurality of chambers at least partially formed by the rotor and the stator and arranged to receive fluid at different pressures to circumferentially displace the rotor with respect to the stator to control a circumferential position of the second camshaft. The control gear is arranged to receive torque to rotate the first and second camshafts and to directly transmit the torque and radial loads to the first camshaft.

According to aspects illustrated herein, there is provided a method of fabricating a camshaft assembly, including: placing a control gear about a first camshaft and in contact with an outer circumferential surface of the first camshaft; positioning the control gear at a specified circumferential position with respect to the outer circumferential surface of the first camshaft; connecting the control gear to the first camshaft by welding, press fitting, or shrink fitting; inserting a second camshaft within the first camshaft; non-rotatably connecting a rotor to the second camshaft; and non-rotatably connecting a stator to the control gear.

BRIEF DESCRIPTION OF THE DRAWINGS

The nature and mode of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
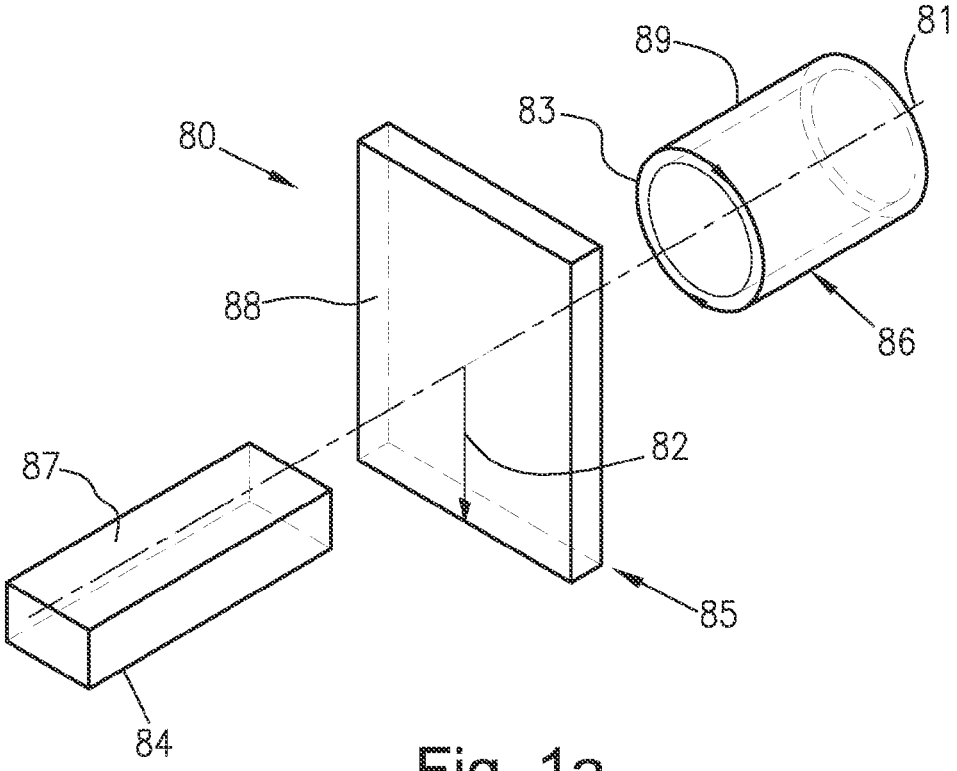
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
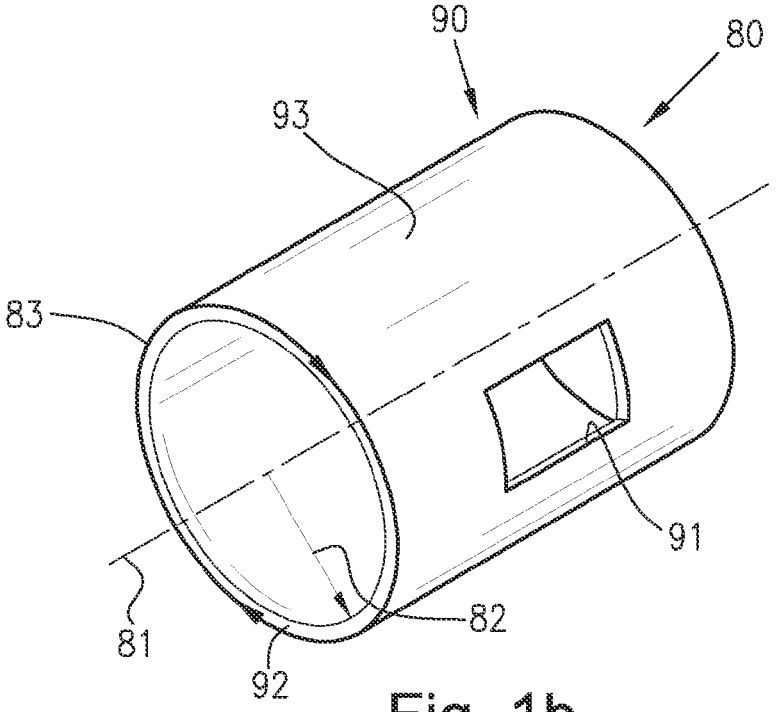
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
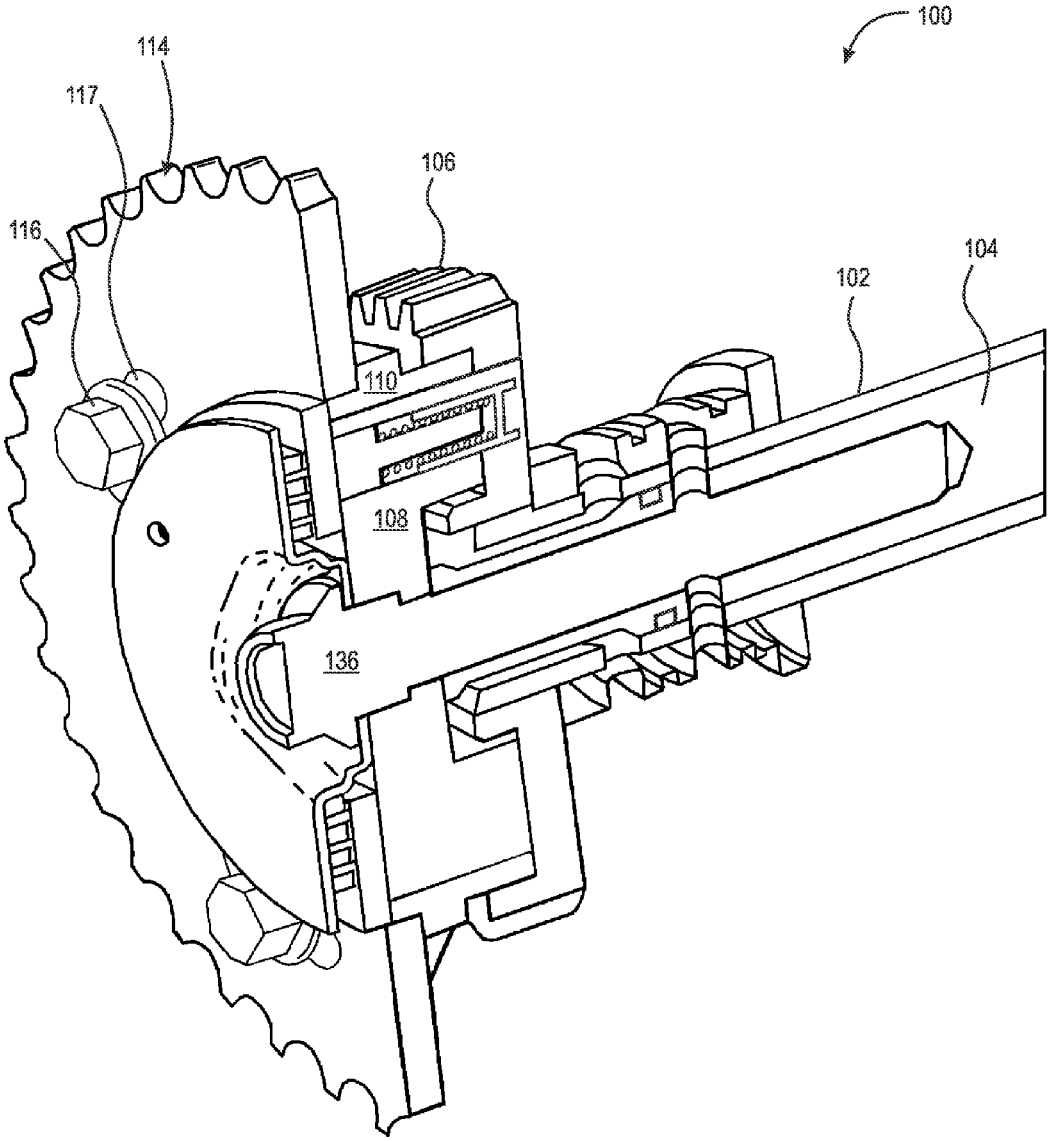
FIG. 2 is a perspective cross-sectional view of a concentric cam shaft phaser.

FIG. 2 is a perspective cross-sectional view of concentric cam shaft phaser 100.

Figure 3:
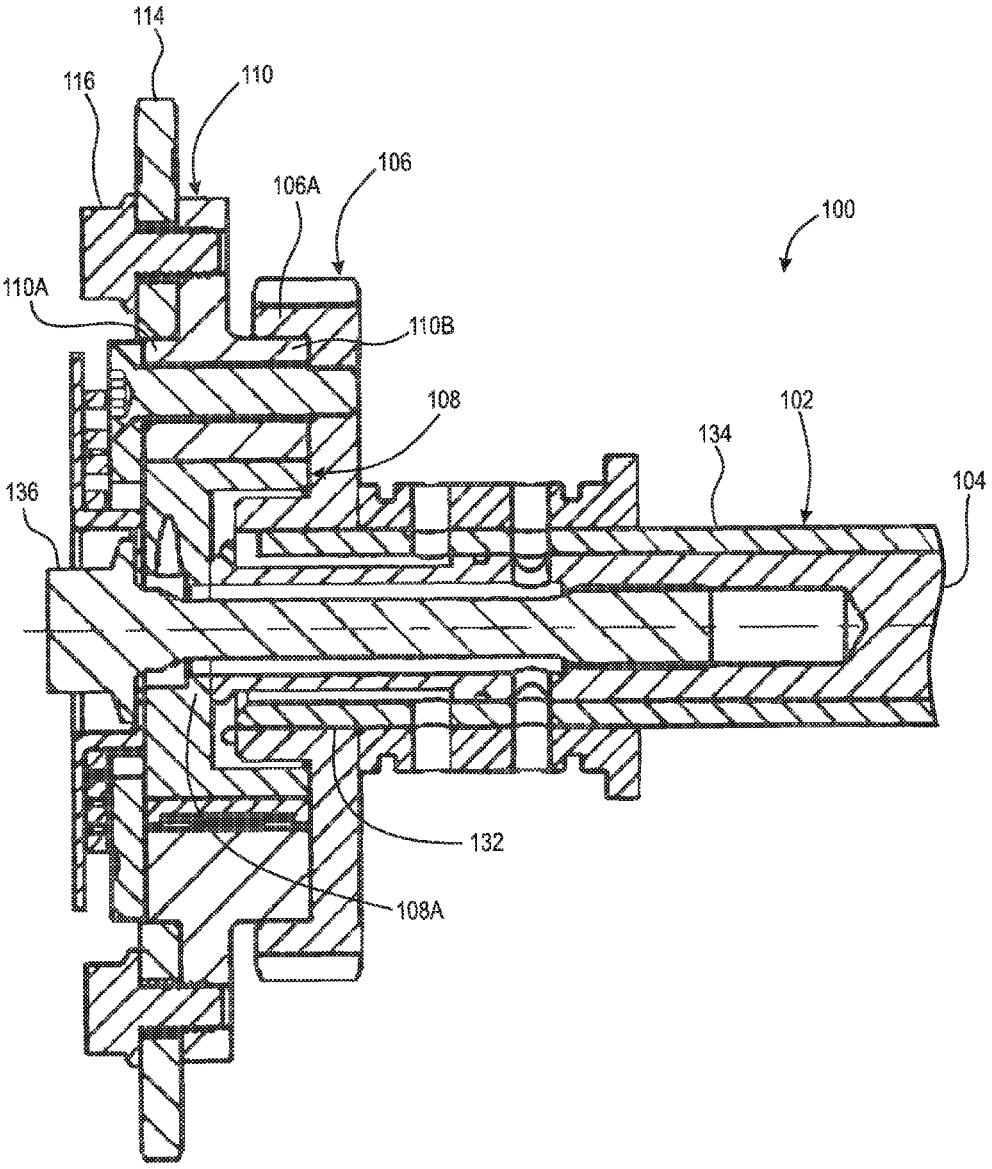
FIG. 3 is a cross-sectional view of the concentric cam shaft phaser of FIG. 2.

FIG. 3 is a cross-sectional view of concentric cam shaft phaser 100 of FIG. 2.

Figure 4:
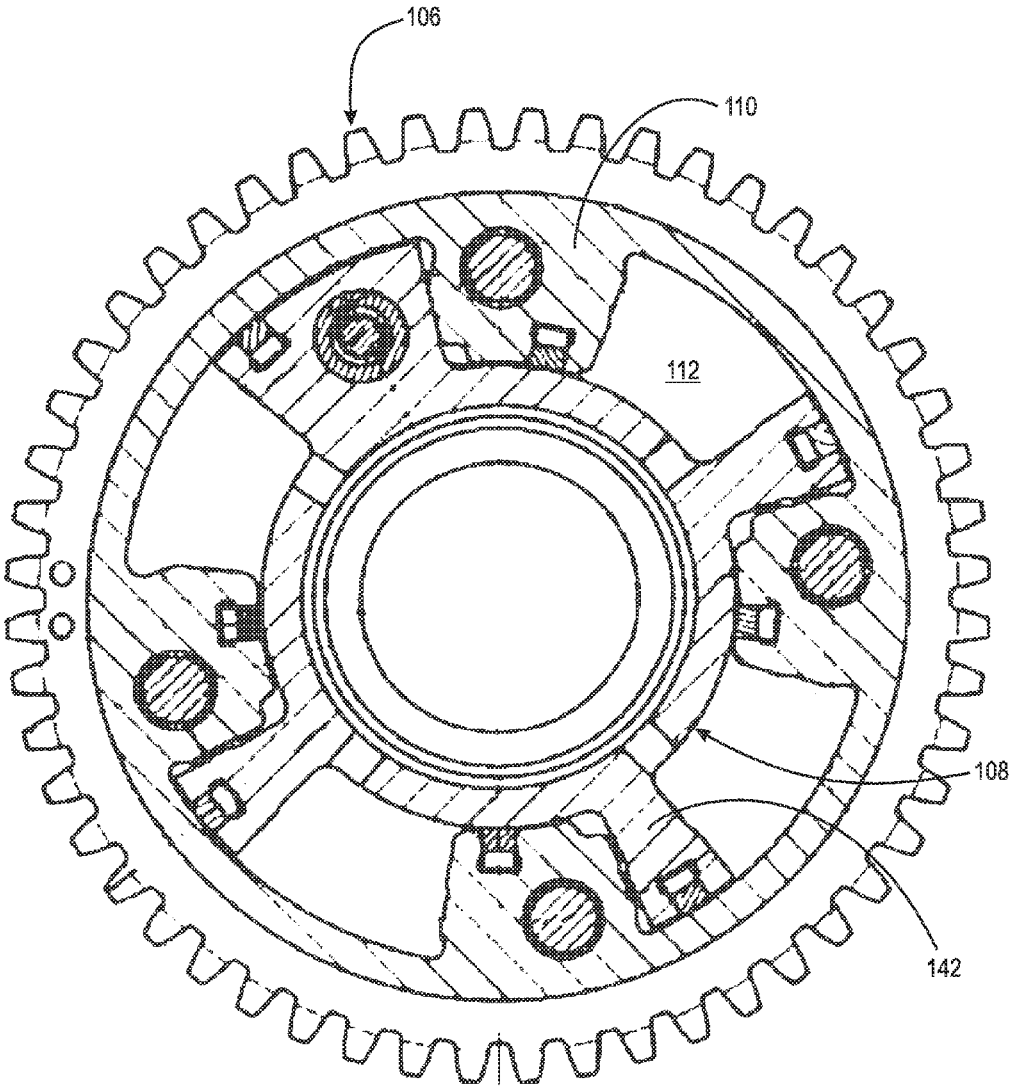
FIG. 4 is a front view of the concentric cam shaft phaser of FIG. 2 showing a control gear, stator, and rotor.

FIG. 4 is a front view of concentric cam shaft phaser 100 of FIG. 2 showing a control gear, stator, and rotor. The following should be viewed in light of FIGS. 2 through 4. Phaser 100 includes portion 101, camshaft 102 and camshaft 104 located radially inward, for example, inside, of camshaft 102. Phaser 100 includes control gear 106, rotor 108 non-rotatably connected to camshaft 104, and stator 110 non-rotatably connected to control gear 106. Control gear 106 is in contact with camshaft 102 and fixedly connected to camshaft 102 by a weld, a press fit, or a shrink fit. By "fixedly connected" we mean control gear 106 is locked to camshaft 102 in axial and circumferential directions and is immovable with respect to camshaft 102. Torque and radial loads applied to control gear 106 are transmitted directly to camshaft 102.

In an example embodiment, phaser 100 includes chambers 112 at least partially formed by rotor 108 and stator 110. Chambers 112 are arranged to receive fluid at different pressures to circumferentially displace rotor 108 with respect to stator 110 to control a circumferential position of camshaft 104. In an example embodiment, phaser 100 includes primary drive gear 114 arranged to transmit torque to rotate camshafts 102 and 104.

Rotor 108 is coupled with stator 110 via the fluid, and rotation of stator 110 is transferred to rotor 108 via the fluid coupling. In an example embodiment, at least a portion of stator 110, for example portion 110A, is located radially inward of portion of primary drive gear 114 and is radially aligned with primary drive gear 114. In an example embodiment, at least a portion of stator 110, for example portion 110B is located radially inward of portion of control gear 106, for example portion 106A, and is radially aligned with control gear 106.

In an example embodiment, at least a portion of rotor 108 is located radially inward of at least a portion of stator 110 and radially aligned with stator 110. In an example embodiment, at least a portion rotor 108, for example, portion 108A, is axially aligned with camshafts 102 and 104.

In an example embodiment, a circumferential position of primary drive gear 114 with respect to stator 110 is adjustable and for a particular circumferential position, primary drive gear 114 is fixedly secured to stator 110 by fasteners 116 passing though slots 117 in gear 114. That is, when fasteners 116 are loosened, primary drive gear 114 is rotatable with respect to stator 110 and when fasteners 116 are tightened, the position of primary drive gear 114 with respect to stator 110 is fixed. In an example embodiment (not shown), primary drive gear 114 and stator 110 are formed of a same single piece of material.

Figure 5:
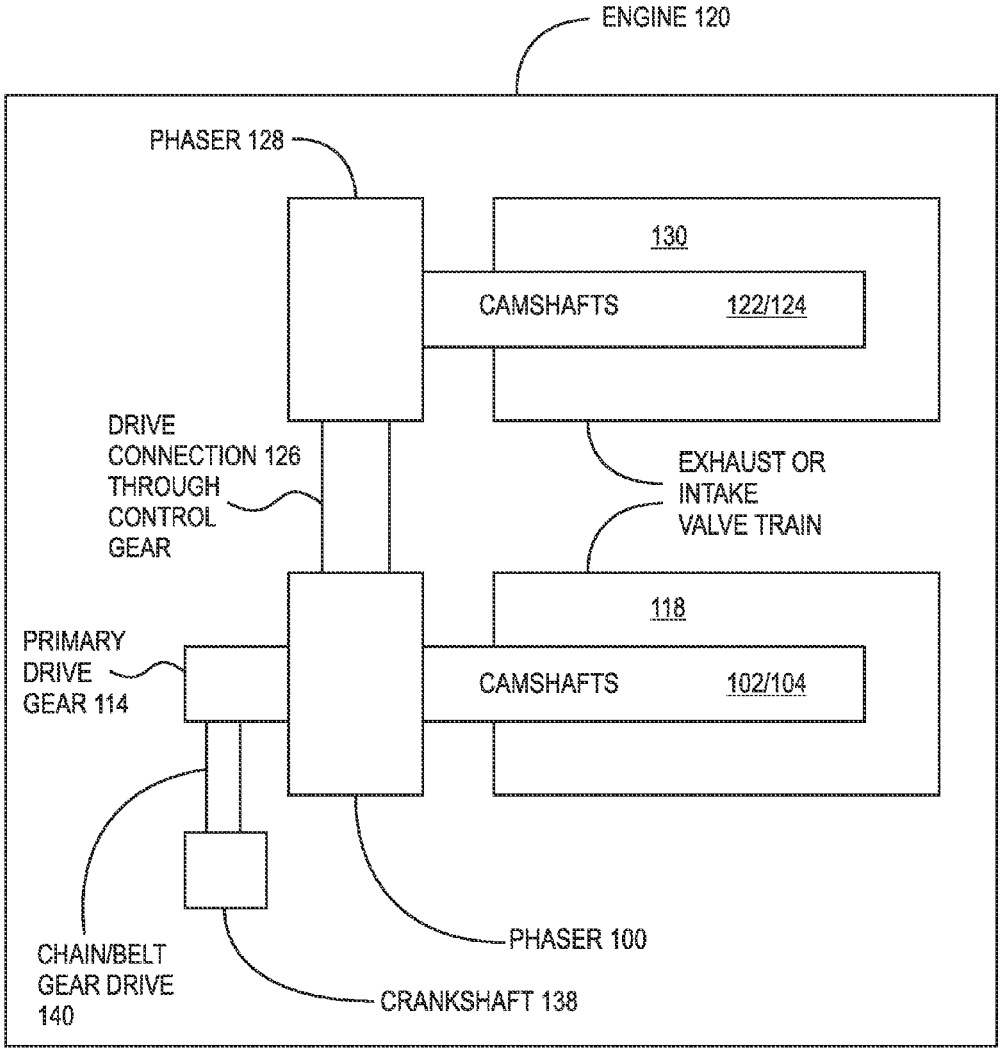
FIG. 5 is a schematic block diagram of an engine with a phaser of FIG. 2 connected to a concentric camshaft.

FIG. 5 is a schematic block diagram of an engine with phaser 100 of FIG. 2 connected to a concentric camshaft. The following should be viewed in light of FIGS. 2 through 5. In an example embodiment, camshafts 102 and 104 are arranged to operate one of an intake or exhaust valve train 118 for internal combustion engine 120. In an example embodiment, control gear 106 is arranged to rotate camshafts 122 and 124 via drive connection 126 to phaser 128 including camshafts 122 and 124. Phaser 100 phases/times phaser 128, which in turn controls camshafts 122 and 124. Phaser 128 is for valve train 130, which is the other of the intake or exhaust valve train for engine 120. In an example embodiment, phaser 128 has the same construction and functionality as phaser 100.

In an example embodiment, control gear 106, in particular, radially inwardly facing surface 132, is in direct contact with radially outwardly facing surface 134 of camshaft 102.

The following provides further detail regarding phaser 100. To resolve the problems noted above regarding radial runout of the control gear and to reliably transfer radial gear loads to the camshaft, control gear 106 is directly mounted on outer camshaft 102 by weld, press fit, or shrink fit. Thus, there are no intermediate components involved in the positioning and securing of control gear 106 to camshaft 102 and the tolerance variations and unreliable transfer of radial gear loads associated with indirect transfer of gear loads through the phaser are eliminated. That is, the direct mounting of control gear 106 to outer camshaft 102 enables the radial runout of gear 106 to be better controlled and for gear loads to be transferred directly to outer camshaft 102.

As noted above, stator 110 is positioned within phaser 100 to enable a compact radial and axial packaging space. Rotor 108 is positioned within stator 110 and is fixed to camshaft 104 by means of central bolt 136. Optional primary drive gear/sprocket pulley 114 can be integrated to stator 110 as one piece, or attached by any means known in the art such as bolt, rivet, or weld. Optional primary drive gear/sprocket pulley 114 is driven by crank shaft 138 as known in the art, by means of chain, belt or gear drive 140. In an example embodiment, the circumferential timing position of primary drive gear 114 relative to stator 110 is adjustable via fasteners 116, for example during engine assembly.

As is known in the art, the phase or angle of camshaft 104 can be varied relative to the crankshaft by regulating the oil flow/pressure within chambers 112 formed by rotor vanes 142 and stator 110. In an example embodiment (not shown), primary drive gear 114 is eliminated and control gear 106 is driven by the crankshaft by means of a gear drive system.

The following should be viewed in light of FIGS. 2 through 5. The following describes a present invention method for fabricating a concentric camshaft phaser. Although the method is presented as a sequence of steps for clarity, no order should be inferred from the sequence unless explicitly stated. A first step places a control gear, such as control gear 106, about a first camshaft, such as camshaft 102, and in contact with an outer circumferential surface of the first camshaft. A second camshaft, such as camshaft 104, is located within the first camshaft. A third step positions the control gear at a specified circumferential position with respect to the outer circumferential surface of the first camshaft. A fourth step connects the control gear to the first camshaft by welding, press fitting, or shrink fitting. A fifth step non-rotatably connects a rotor, such as rotor 108, to the second camshaft. A sixth step non-rotatably connects a stator, such as stator 110, to the control gear.

In an example embodiment, a seventh step non-rotatably connects a primary drive gear to the stator. In an example embodiment, an eighth step forms a plurality of chambers at least partially bounded by the rotor and the stator and arranged to receive fluid at different pressures to circumferentially displace the rotor with respect to the stator to control a circumferential position of the second camshaft. In an example embodiment, at least a first portion of the stator is located radially inward of a portion of the control gear and radially aligned with the control gear, and at least a second portion of the stator is located radially inward of a portion of the primary drive gear and radially aligned with the primary drive gear.

In an example embodiment, at least a first portion of the rotor is located radially inward of a portion of the stator and radially aligned with the stator, and at least a second portion of the rotor is axially aligned with the first and second camshafts. In an example embodiment, a ninth step circumferentially positions the primary drive gear with respect to the stator and a tenth step fixedly secures the primary gear to the stator with at least one fastener, such as fastener 116. In an example embodiment, an eleventh step forms the primary drive gear and the stator of a same single piece of material.

Figure 6:
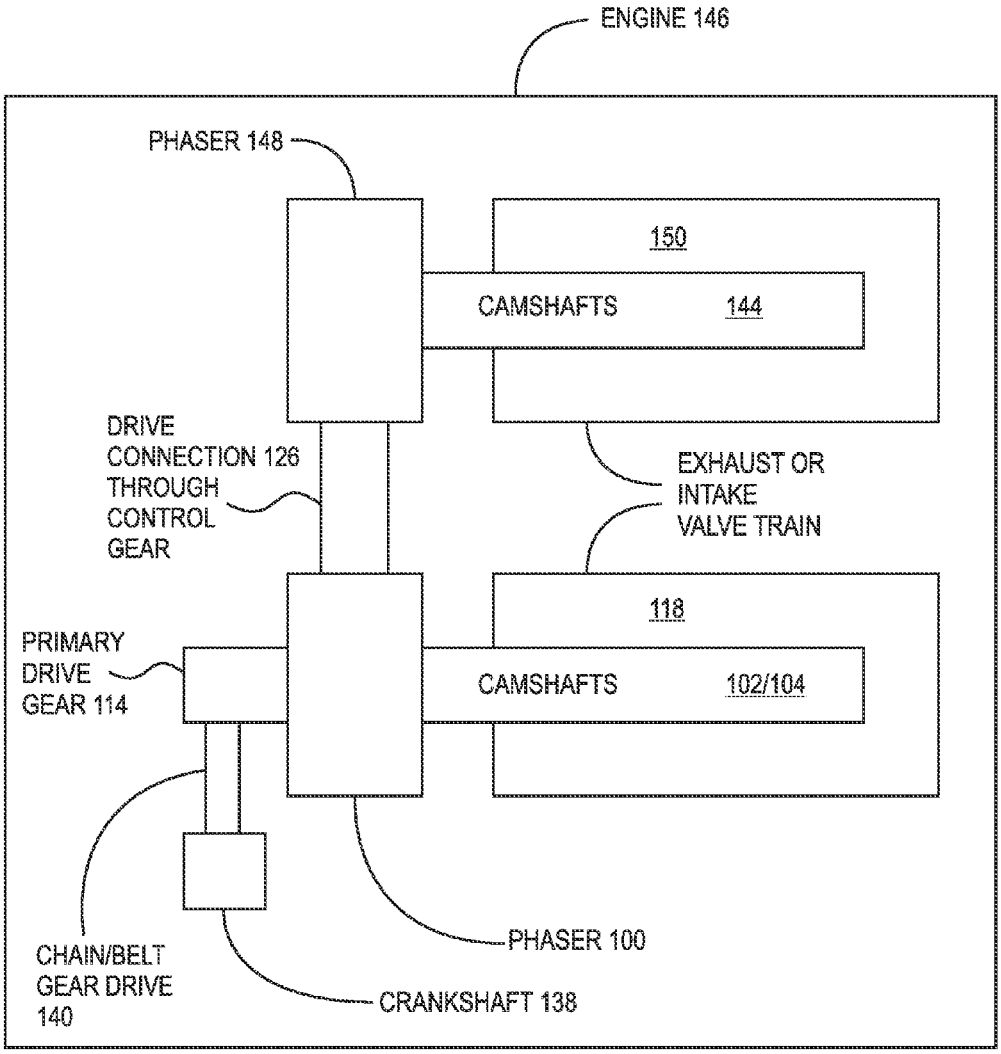
FIG. 6 is a schematic block diagram of an engine with a phaser of FIG. 2 connected to a phaser and single camshaft; and, FIG. 7 is a schematic block diagram of an engine with a phaser of FIG. 2 connected to a gear and a single camshaft.

FIG. 6 is a schematic block diagram of an engine with phaser 100 of FIG. 2 connected to a phaser and single camshaft 144. In an example embodiment, camshafts 102 and 104 are arranged to operate one of an intake or exhaust valve train 118 for internal combustion engine 146. In an example embodiment, control gear 106 is arranged to rotate camshaft 144 via drive connection 126 to phaser 148 including camshaft 144. Phaser 100 phases/times phaser 148, which in turn controls camshaft 144. Phaser 148 is for valve train 150, which is the other of the intake or exhaust valve train for engine 146.

Figure 7:
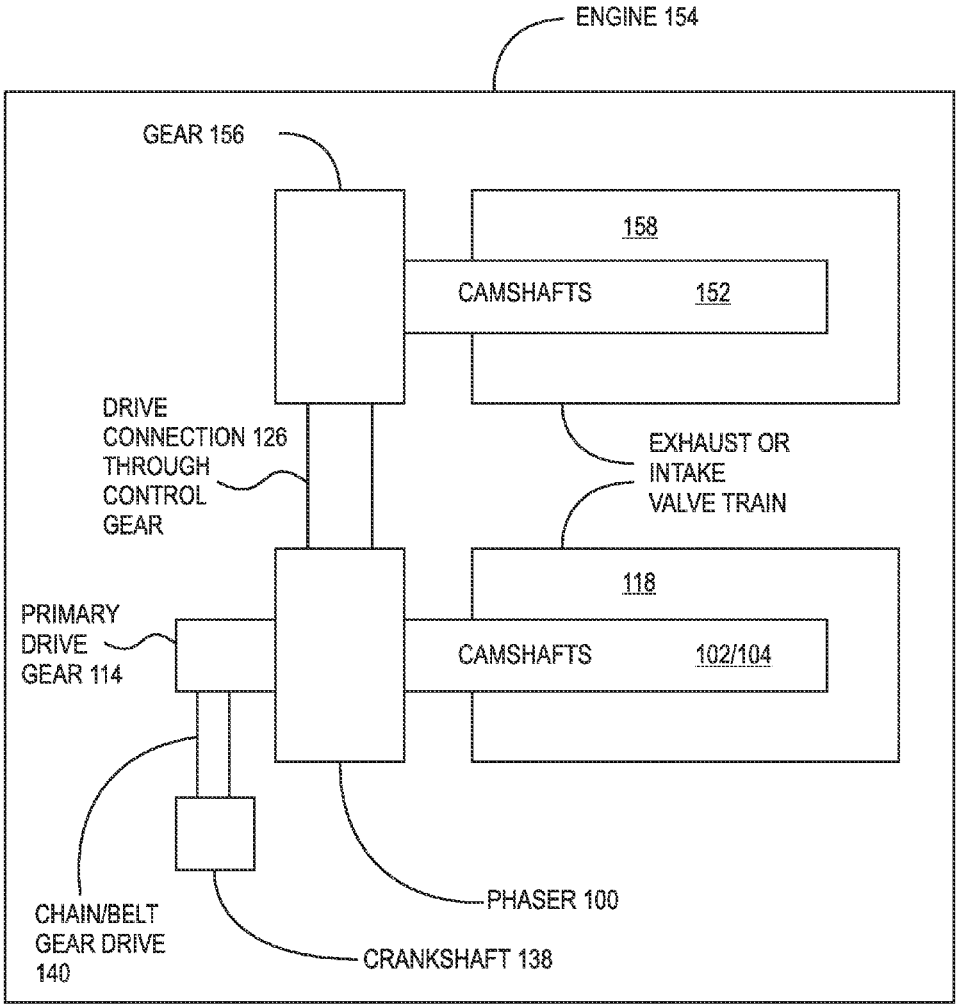

FIG. 7 is a schematic block diagram of an engine with phaser 100 of FIG. 2 connected to a gear and single camshaft 152. In an example embodiment, camshafts 102 and 104 are arranged to operate one of an intake or exhaust valve train 118 for internal combustion engine 154. In an example embodiment, control gear 106 is arranged to rotate camshaft 152 via drive connection 126 to gear 156 and camshaft 152. Phaser 100 phases/times gear 156, which in turn controls camshaft 152. Gear 156 and camshaft 152 are for valve train 158, which is the other of the intake or exhaust valve train for engine 154.

The following describes a present invention method for fabricating a concentric camshaft phaser. Although the method is presented as a sequence of steps for clarity, no order should be inferred from the sequence unless explicitly stated. A first step assembles all the components of the phaser, for example as described above, with the exception of camshafts 102 and 104. A second step assembles camshafts 102 and 104 in the nested configuration described above. A third step connects the nested camshafts to the components assembled in step 1, for example, by shrink fit, press fit, or weld.

The following describes a present invention method for fabricating a concentric camshaft phaser. Although the method is presented as a sequence of steps for clarity, no order should be inferred from the sequence unless explicitly stated. A first step assembles all the components of the phaser, for example as described above, with the exception of gear 106 and camshafts 102 and 104. A second step assembles camshafts 102 and 104 in the nested configuration described above. A third step connects gear 106 to the nested camshafts. A fourth step connects the nested camshafts and gear 106 to the components assembled in step 1, for example, by shrink fit, press fit, or weld.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A concentric cam shaft phaser, comprising:

a first camshaft;

a second camshaft located radially inside of the first camshaft;

a control gear in contact with the first camshaft and fixedly connected to the first camshaft by a weld, a press fit, or a shrink fit;

a rotor non-rotatably connected to the second camshaft;

a stator non-rotatably connected to the control gear; and, a primary drive gear, separate from the control gear, fixedly secured to the stator, wherein at least a portion of the stator is located radially inward of a portion of the control gear and radially aligned with the control gear.

2. The concentric cam shaft phaser of claim 1, wherein the primary drive gear is arranged to transmit torque to rotate the first and second camshafts.

3. The camshaft assembly of claim 2, wherein the primary drive gear and the stator are formed of a same single piece of material.

4. The camshaft assembly of claim 3, wherein:

the rotor is coupled with the stator via the fluid; and, rotation of the stator is transferred to the rotor via coupling of the rotor with the stator.

5. The concentric cam shaft phaser of claim 1, further comprising:

a plurality of chambers at least partially formed by the rotor and the stator and arranged to receive fluid at different pressures to circumferentially displace the rotor with respect to the stator to control a circumferential position of the second camshaft with respect to the first camshaft.

6. The camshaft assembly of claim 1, wherein at least a portion of the stator is located radially inward of a portion of the primary drive gear and radially aligned with the primary drive gear.

7. The camshaft assembly of claim 1, wherein at least a portion of the rotor is located radially inward of a portion of the stator and radially aligned with the stator.

8. The camshaft assembly of claim 1, wherein at least a portion of the rotor is axially aligned with the first and second camshafts.

9. The camshaft assembly of claim 1, further comprising:

a primary drive gear non-rotatably connected to the stator and arranged to transmit torque and radial loads to rotate the first and second camshafts, wherein:

a circumferential position of the primary gear with respect to the stator is adjustable; and, in the circumferential position, the primary gear is fixedly secured to the stator by at least one fastener.

10. The camshaft assembly of claim 1 wherein the first and second camshafts are arranged to operate an intake or exhaust valve train for an internal combustion engine.

11. The camshaft assembly of claim 1 wherein the control gear is arranged to rotate third and fourth camshafts.

12. The camshaft assembly of claim 1 wherein the control gear is in direct contact with a radially outwardly facing surface of the first camshaft.

13. The camshaft assembly of claim 1 wherein torque applied to rotate the control gear is transmitted directly to the first camshaft by the control gear.

14. A concentric camshaft phaser, comprising:

a first camshaft;

a second camshaft located radially inward of the first camshaft;

a control gear in contact with a radially outwardly facing surface of the first camshaft and fixedly connected to the first camshaft by a weld, a press fit, or a shrink fit;

a rotor non-rotatably connected to the second camshaft;

a stator non-rotatably connected to the control gear;

a primary drive gear, separate from the control gear, fixedly secured to the stator; and, a plurality of chambers at least partially formed by the rotor and the stator and arranged to receive fluid at different pressures to circumferentially displace the rotor with respect to the stator to control a circumferential position of the second camshaft, wherein: the primary drive gear is arranged to receive torque and radial loads to rotate the first and second camshafts and to directly transmit the torque and radial loads to the control gear.

15. The camshaft assembly of claim 14 wherein the first and second camshafts are arranged to operate an intake or exhaust valve train for an internal combustion engine.

16. The camshaft assembly of claim 14, wherein at least a portion of the stator is located radially inward of a portion of the control gear and radially aligned with the control gear.

17. A concentric cam shaft phaser, comprising:

a control gear arranged to contact with a first camshaft and arranged to be fixedly connected to the first camshaft;

a rotor arranged to non-rotatably connected to a second camshaft, the second camshaft located radially inside of the first camshaft;

a stator non-rotatably connected to the control gear; and, a primary drive gear, separate from the control gear, fixedly secured to the stator, wherein at least a portion of the stator is located radially inward of a portion of the control gear and radially aligned with the control gear.

18. The camshaft assembly of claim 17, wherein at least a portion of the stator is located radially inward of a portion of the control gear and radially aligned with the control gear.

19. The camshaft assembly of claim 17, wherein at least a portion of the stator is located radially inward of a portion of the primary drive gear and radially aligned with the primary drive gear.

* * * * *